US005078322A

United States Patent [19]

Torntore

[11] Patent Number: 5,078,322

[45] Date of Patent: Jan. 7, 1992

[54] LOW PRESSURE HIGH VOLUME SPRAY GUN

[75] Inventor: Anthony J. Torntore, Bloomington, Minn.

[73] Assignee: Wagner Spray Tech Corporation, Minneapolis, Minn.

[21] Appl. No.: 261,625

[22] Filed: Oct. 24, 1988

[51] Int. Cl.[5] ..... B05B 1/28; B05B 7/24; B05B 7/12

[52] U.S. Cl. ..... 239/289; 239/296; 239/301; 239/346; 239/353; 239/367; 239/414; 239/416.2; 239/417.3; 239/527

[58] Field of Search ..... 239/289, 296, 300, 301, 239/346, 353, 365, 367, 373, 414, 415, 416.2, 416.4, 417.3, 526, 527, 528

[56] References Cited

U.S. PATENT DOCUMENTS

| | | | |
|---|---|---|---|
| 1,382,640 | 6/1921 | Heinrich | 239/528 |
| 1,650,686 | 11/1927 | Binks | 239/527 |
| 1,906,975 | 5/1933 | Larson | 239/353 |
| 2,032,789 | 3/1936 | Bramsen | 239/527 |
| 2,670,239 | 2/1954 | Ditch | 239/415 |
| 2,868,585 | 1/1959 | Esser | 239/527 |
| 2,888,207 | 5/1959 | Sykes | 239/528 |
| 2,904,262 | 9/1959 | Peeps | 239/367 |
| 2,934,246 | 4/1960 | Briggs | 239/367 |
| 3,076,608 | 2/1963 | Valles | 239/526 |
| 3,796,376 | 3/1974 | Farnsteiner . | |
| 4,171,096 | 10/1979 | Welsh et al. | 239/301 |
| 4,651,929 | 3/1987 | Kränzle | 239/526 |
| 4,760,962 | 8/1988 | Wheeler | 239/353 X |
| 4,905,905 | 3/1990 | Hufgard | 239/301 |

FOREIGN PATENT DOCUMENTS

| | | | |
|---|---|---|---|
| 2267154 | 11/1975 | France | 239/527 |

OTHER PUBLICATIONS

"The Accuspray System", Accuspray (1988).
"LPHV a Friend to the Bottom Line", CAN-AM Engineered Products, Inc.
"HVLP System 89", The DeVilbiss Company.
"Eaglespray Turbo Spraying Systems", Amity Quality Products, Inc.
"Fuji: The Best Low Pressure Sprayer-In Any Language", Fuji Industrial Products, Inc.
"Handbook, Installation, Operator and Service with Parts Breakdown, Airmix Manual Spray Gun", Kremlin, Inc., pp. 1-9 (1986).
"Operation and Maintenance, Kremlin JX/JXLP Gun", Kremlin Inc.
"T/E, Color Matches, Film Build., DNR Compliance, It's All There", Turbo Spray Midwest Inc. (1986).
"Volumair", Volumair, France.

*Primary Examiner*—Andres Kashnikow
*Assistant Examiner*—William Grant
*Attorney, Agent, or Firm*—Faegre & Benson

[57] ABSTRACT

A spray gun designed for utilization with low pressure and high volume air supplies to obtain high product transfer efficiencies. The spray gun is designed for connection to an air supply at two locations on the gun with one location providing non-pressure bleeding connection to the air supply and with the other allowing air to continually flow through the gun. The design of the gun is particularly sized with internal passages to allow high CFM and low PSI functions. An air cap assembly to control spray patterns for vertical, horizontal and circular sprays is arranged on the outlet end of the gun. The unit as designed eliminates the utilization and requirement of exterior valving and air control mechanisms.

15 Claims, 4 Drawing Sheets

LOW PRESSURE HIGH VOLUME SPRAY GUN

FIELD OF THE INVENTION

This invention relates generally to spray guns designed for the delivery of volatile organic compounds, primarily paint ingredients and more particularly to such a spray gun which is designed for high volume and low pressure operations.

SHORT SUMMARY OF THE INVENTION

This invention is pertinent to spray guns and spray gun equipment which is designed for high CFM delivery at relatively low air pressures. The unit includes a body having a complete internal valving mechanism for the control of air therethrough from a first air inlet to provide a non-bleeding type gun and through a second inlet which will provide a bleeding type gun. As known in the art a non-bleeding unit does not allow air to continually pass through the gun while a bleeding gun is defined as one which allows air to continually flow through the gun. In high volume, low pressure situations the air supply normally includes a turbine rather than a reservoir tank system and when used in the non-bleeding position, relief must be provided for air which is continually provided from the turbine.

The spray gun of the invention provides a complete internal valving and sealing mechanism to eliminate the requirement of external air controls.

The advantage of low pressure, high volume spraying techniques insures high product transfer efficiencies and eliminates bounce back and overspray that will normally occur in high pressure units.

The particular air cap is, as incorporated into this invention, a one piece arrangement with spring ball locating mechanisms for positioning the same into its various delivery aspects. The various positions of this air cap include means for a horizontal, vertical and circular spray pattern.

Also included in the applicant's spray gun is a material flow adjustment in cooperation with an actuating trigger mechanism to control the amount of fluid being sprayed from an attachable materials container. This attachable container is pressurized from the entering air supply to deliver fluid from the container through the adjustable air cap structure.

BACKGROUND AND OBJECTS OF THE INVENTION

The applicant is well aware of various spray guns that have been provided in the past. This industry is highly developed and various applications utilize high pressure systems in comparison to the applicant's unit which is developed on a system of high volume, high CFM, delivery at relatively low pressures.

In the applicant's consideration of the prior art various United States Patents are pertinent. Such Patents include Groth, et al, U.S. Pat. No. 4,392,614; Snyder, et al, U.S. Pat. No. 4,553,700; Snyder, et al, No. U.S. Pat. No. 4,591,096; and Roe, et al, U.S. Pat. No. 469,423.

The primary concept with the applicant's unit is the utilization of the high volume delivery at low pressures in comparison to high pressure spray guns.

The particular Patents cited above do not incorporate either the structure of the applicant's gun, including the two air supply inlets, the positive control for non-bleeding or bleeding applications nor do they provide for the high product transfer efficiency that is available with the applicant's unit.

Applicant's unit further provides an in-line valve control mechanism which is not available in the prior art.

It is therefore an object of the applicant's invention to provide a low pressure, high volume spray gun incorporating relatively large internal air passages to allow for high CFM delivery from a turbine source.

It is a further object of the applicant's invention to provide a spray gun for utilization with low pressure and high volume applications wherein in-line air controls are provided to eliminate external air control mechanisms.

It is a further object of the applicant's invention to provide a spray gun particularly for utilization with low pressure, high volume deliveries including an air cap assembly for delivery of material and preselected pattern arrangements including horizontal, vertical and circular spray patterns.

It is still a further object of the applicant's invention to provide a low pressure, high volume spray gun incorporating dual air entries which allow for accommodation of hose positioning in accordance with the particular application to which the gun is being placed.

These and other objects and advantages of the applicant's invention will more fully appear from a consideration of the enclosed drawings and description of the invention.

SHORT DESCRIPTION OF THE DRAWINGS

DESCRIPTION OF A PREFERRED FORM OF THE INVENTION

Figure 1:
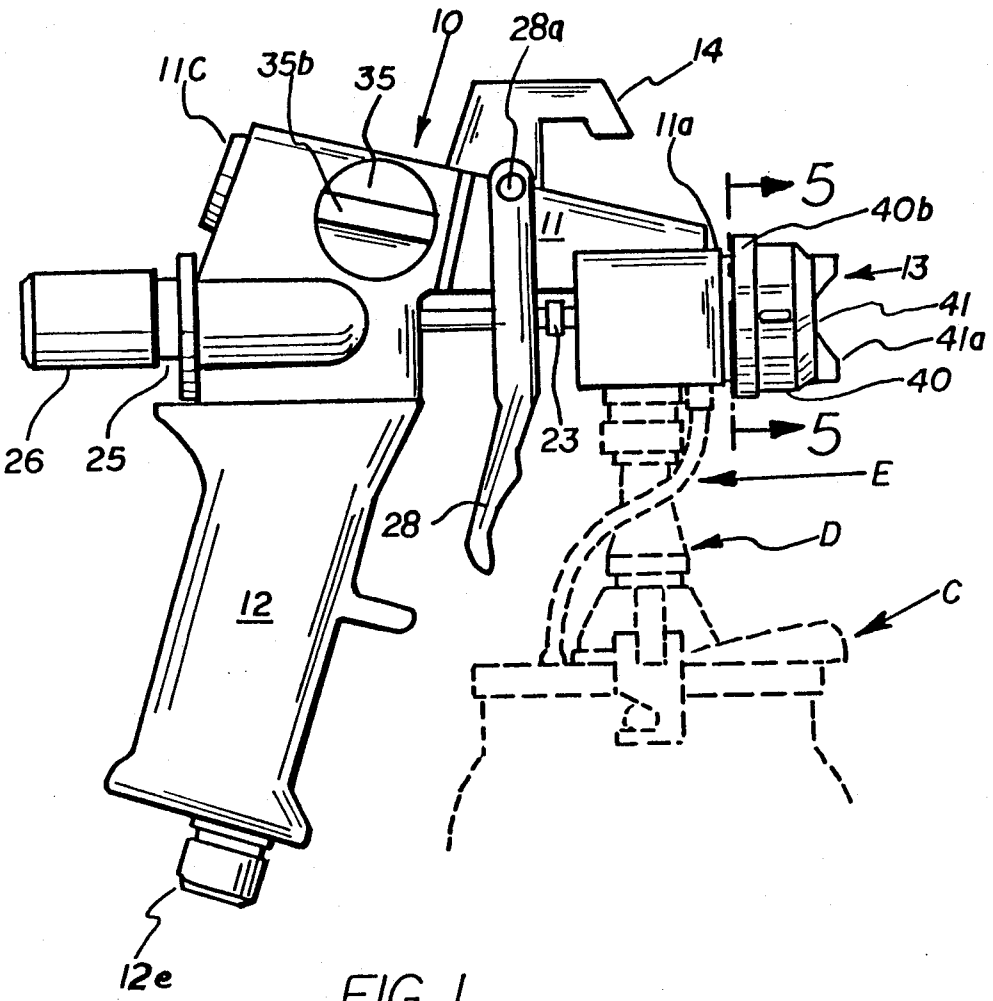
FIG. 1 is a side elevation view of the spray gun embodying the applicant's concepts and illustrating the material canister in dotted lines.
Figure 3:
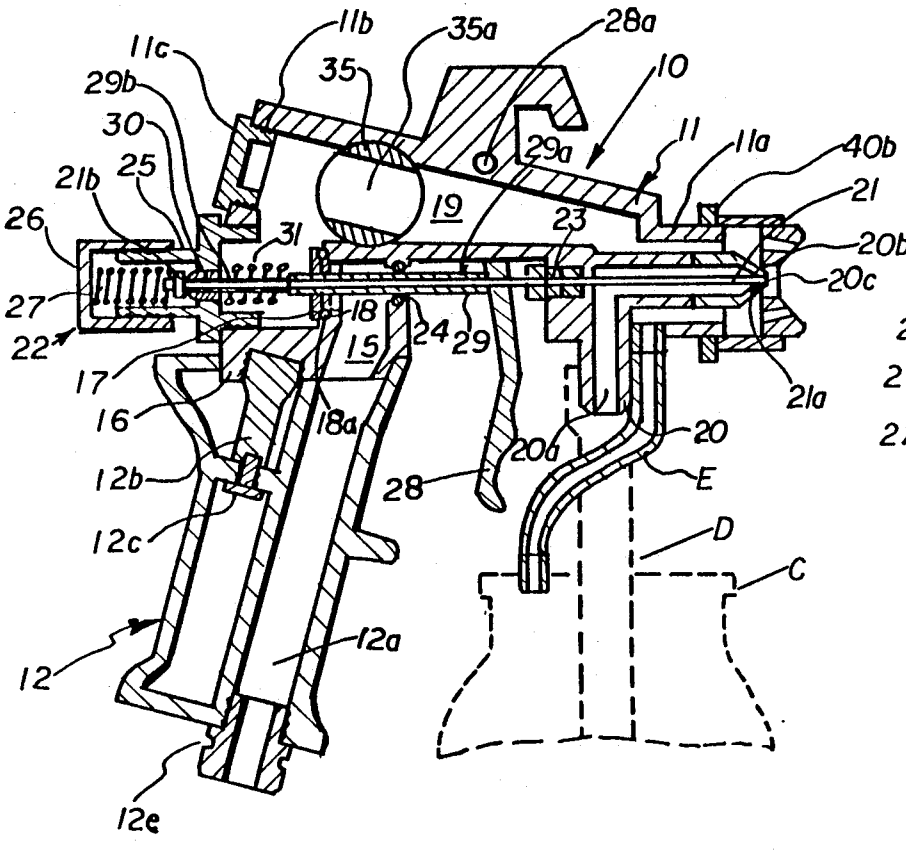
FIG. 3 is a vertical section taken substantially along lines 3—3 of FIG. 2 and illustrating the operative trigger mechanism in a first closed position.

In accordance with the accompanying drawings the applicant's spray gun embodying the concepts of his invention is generally designated 10 and is illustrated in FIGS. 1 and 3 with a paint supply cannister C and its requisite connector elements including an attachment and material delivery conduit D and a cannister pressurizing tube E. The cannister C, delivery tube D and pressurizing tube E are illustrated in dotted lines as being normally provided with any spray gun.

Primarily, applicant's spray gun 10 may best be described as three individual inseparable sections. These sections include a cast or molded body unit 11, termed an air introduction and control member, a handle portion 12 attachable to the body portion 11 and an adjustable cap for controlling various spray patterns 13.

For purposes of convenience an exterior hook 14 is provided on the body unit 11 for temporary hanging or storage of the gun 10.

The body 11 provides a housing for the air control systems for both the bleeding and non-bleeding operation of the unit. A non-bleeding spray gun is defined as one which prevents air flow through the gun when the trigger or actuating mechanism is in closed position which similarly closes the needle system and flow of the coating material from the gun. With such a system, whether a compressor or turbine air supply system is provided means must be provided to accommodate the stoppage of air flow. With a turbine, which continually provides air, a relief valve mechanism must be provided to prevent back pressure build up. With a compressor system, an air reservoir tank is provided and air storage is accommodated and the compressor will simply shut off when the pressure in the reservoir reaches a certain amount.

With a bleeding type spray gun, air is allowed to continually flow through the gun and therefore no relief system is required. Applicant's spray gun 10 is capable of operating in both modes and, as will become obvious hereinafter, the particular bleeding or non-bleeding situation may be controlled by the particular application to which the spray gun is placed. For example, spraying within a cabinet may require the hose to be attached to the gun in the non-bleeding position while spraying in an open non-confined area would permit the hose to be attached at either of the selected positions, i.e. bleeding or non-bleeding.

Figure 4:
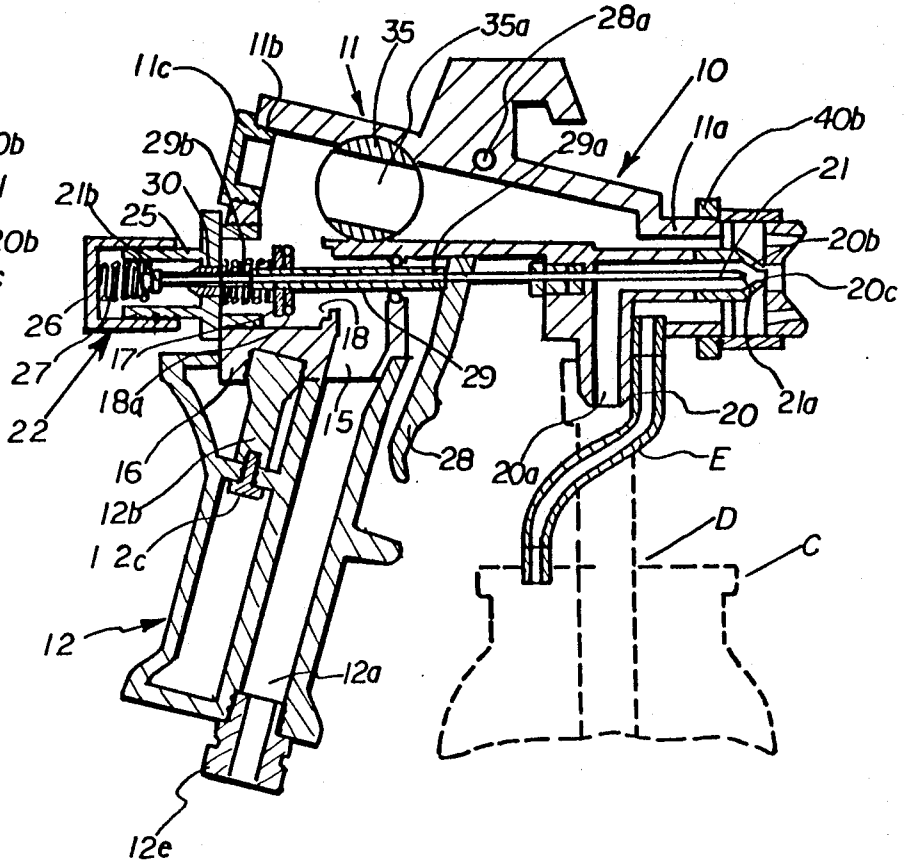
FIG. 4 is a view similar to FIG. 3 taken along lines 4—4 and illustrating the trigger mechanism and the valving mechanism in open air flow position.

The particular shape of the air introduction unit is best illustrated in the cross sections of FIGS. 3 and 4. A first inlet aperture 15, generally arcuate in shape, is provided through the handle attachment surface 16 of body 11 and this aperture extends upwardly into the body 11 into a valving-seat arrangement with the valve member designated 17 and the seat section designated 18. An O-ring seal 18*a* may be provided for effective sealing of the valve 17 to the seat 18. The operation and movement of the valve 17 will be described when the trigger and needle actuating portion of the invention is described. Obviously air entering through aperture 15 is controlled by the valve 17 and the flow aperture therethrough extends into an air delivery passage 19 which extends from the rear of the gun forwardly to the air and material delivery end 11*a* of the gun to which the discharge cap assembly 13 is attached.

Figure 2:
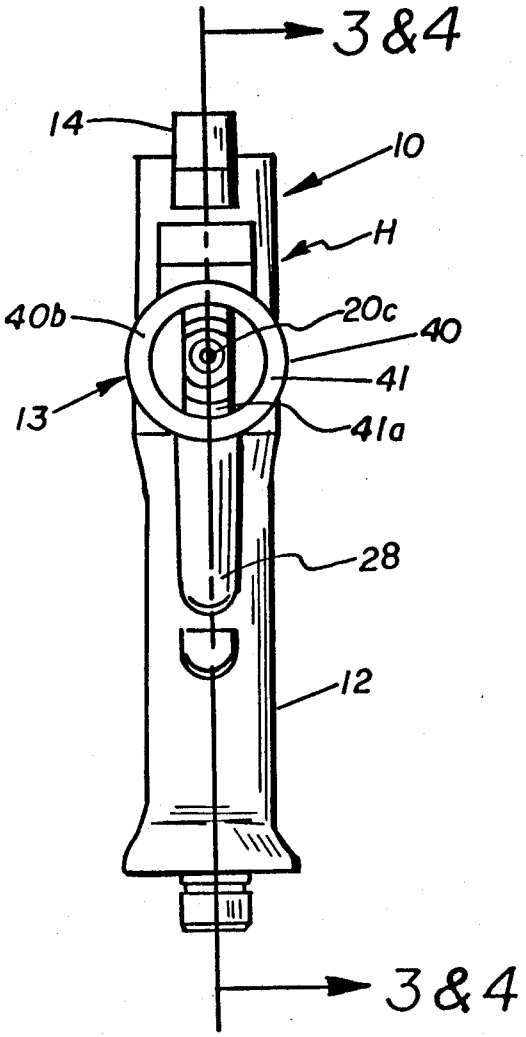
FIG. 2 is a front elevation view of the unit as illustrated in FIG. 1.

As particularly illustrated in FIGS. 2 and 3 the can pressurizing tube E also communicates with chamber 19 to direct air into the can C for pressurizing the same and forcing the viscous coating material upwardly through the connective can outlet D for ultimate spraying from and through the discharge cap 13. As illustrated in FIGS. 2 and 3, a material inlet boss 20 extends downwardly for connection to discharge outlet D and is provided with a material flow passage 20*a* therein. As further illustrated in FIGS. 2 and 3, the material flow passage 20*a* located within the interior of the body 11 includes a forwardly extending passage, a continuation of passage 20*a*, to a conically formed outlet end 20*b*. Obviously, the flow of material is from the can C through the discharge conduit D into passage 20*a* for a final dispersion through the conical outlet 20*b* which provides a discharge opening 20*c* at the apex thereof.

A material flow control needle valve 21 extends from the apex of the conically shaped material discharge tip 20*b* entirely through the body of the gun and exits a rear surface of the gun into a needle valve control chamber 22. Needle valve 21 includes elongated rod having a tapered forward end 21*a* and terminating in a radially extending flange or abutment end 21*b* which end is located in the adjustment housing 22. As needle valve 21 passes through various body portions it is necessary that sealing elements be applied thereto to prevent the leakage of air from the unit. These sealing members include a first packing element 23 adjacent the tapered end 21*a* and a second O-ring or similar seal 24 arranged as the rod passes through the body and through the air inlet passage 15 at the rear portion of the body 11 immediately frontal of the aforementioned valve 17 and corresponding seat 18.

The needle adjustment housing 22 is afforded by a threaded extension 25 to which a cap 26 is threadably positionable. Interposed between the inner surface of cap 26 and the aforementioned radially extending flange 21*b* of the rod 21 is a compression spring 27. The material flow through the orifice 20*c* is controlled by adjustment of the cap 26 against the spring member 27 and flange 21*b* and adjustment of the cap 26 governs the available movement of the rod 21 upon actuation of the trigger 28 which is pivotally attached to the body 11 of the gun 10 as through pivot point 28*a*.

Actuation of the needle valve 21 is obtained by rearward movement of trigger 28 and in order to accomplish this rearward movement or opening of aperture 20*c* and closing thereof upon release of trigger 28 an actuating, generally cylindrical, longitudinally extending, hollow actuating rod 29 is provided. Rod 29 combines a stepped section 29*b* with a first larger diameter section 29*a* which has its forwardmost end in abutting relation to the rear of trigger 28. It is this enlarged rod portion that is sealed at seal 24 and the needle valve 21 is arranged interiorly of and is free to slide within the actuating element 29. Arranged at the rearward end of the actuating rod 29 is the reduced diameter portion 29*b* which extends through an additional seal 30 arranged at the entrance to the adjustment housing 22 such that the reduced diameter portion 29*b* abuts with the radially extending flange 21*b* of the needle valve 21. When the trigger 18 is drawn rearwardly the actuating rod 29 will abut with the extending flange 21*b* of needle valve 21 and force the same rearwardly against spring 27. Obviously upon release of the trigger the needle valve 21 will be forced forwardly into closed position by the spring 27.

Also secured to the larger diameter portion 29*a* of actuating rod 29 is the aforementioned valve member 17. Arranged between this valve member 17 and an interior surface of body 11 is a second compression spring 31. This spring member serves to bring the actuating rod 29 and attached valve member 17 forwardly upon release of the trigger to seal the valve member 17 against seat 18 and thus close off air flow through the passage 15 into the forwardly extending passage 19.

This particular actuation illustrates the non-bleeding type gun operation in that air is prevented from flowing through the gun unless the trigger 28 is actuated.

Attached to the rear of the gun and in communication with the entrance opening 15 is a pistol grip handle 12. This handle provides a passage 12*a* therethrough to allow communication and flow of air from the source of air, turbine or compressor, into the handle 12 and into body portion 11. The handle 12 is connected to the molded body 11 through lug 12*b* affixed to the body 11 and an attachment fastener 12*c*. As illustrated in FIGS. 3 and 4 a quick connect air hose coupling 12*e* is threadably received into the passage 12*a*.

When operating at low pressure, high volume air passing through the gun creates friction heat. The particular handle utilized to overcome this heat is provided from an approximately 43% fiberglass filled nylon. Obviously the innerconnect between passage 12*a* and passage 15 must be air tight and sealants are provided at the connective points of the handle 12 and body 11.

Figure 8:
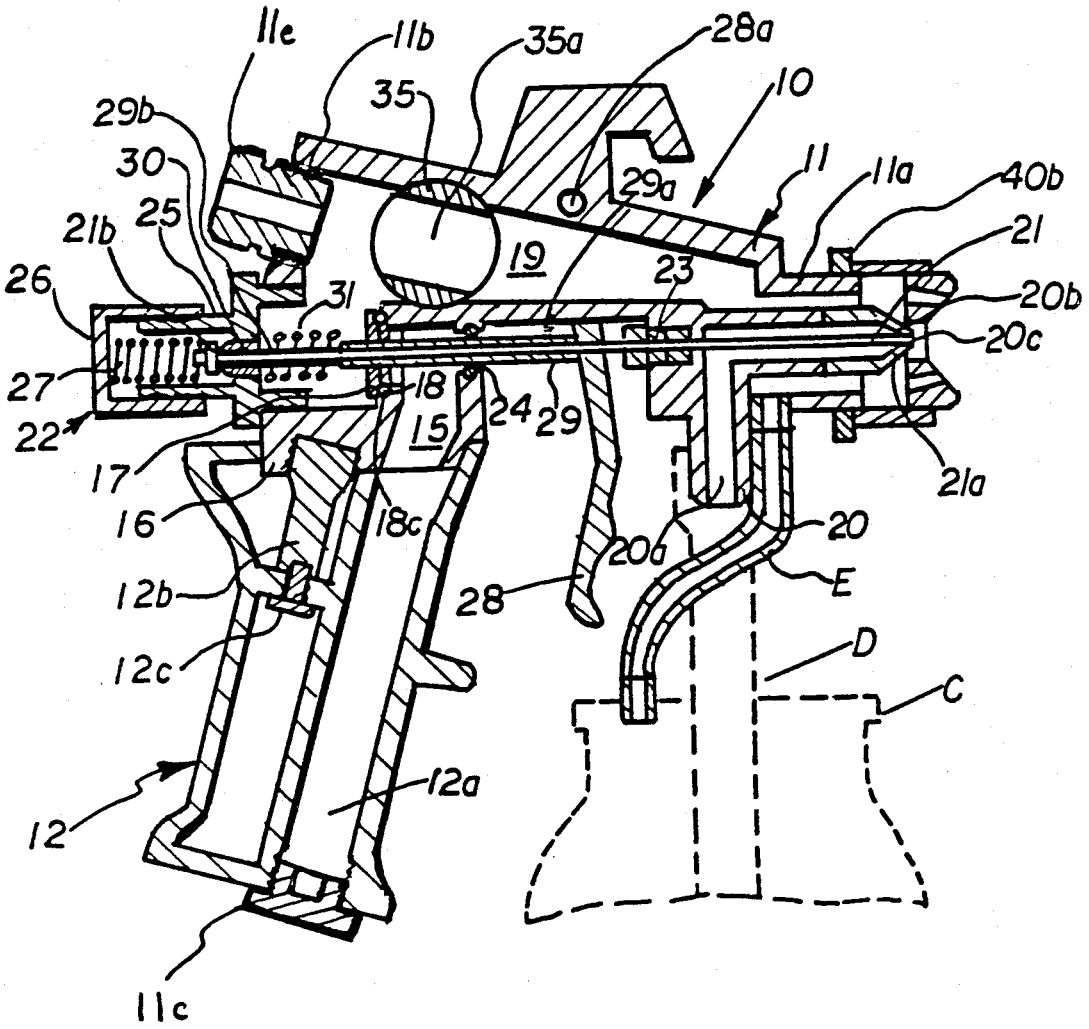
FIG. 8 is a vertical section similar to that of FIG. 3 except with the gun in a bleeder configuration.

When functioning as a bleeder type gun as shown in FIG. 8 a second, threaded, air inlet passage 11*b* is provided at the rear of the gun in alignment with the forwardly extending internal passage 19. As illustrated in FIGS. 3 and 4 a plug 11*c* is normally utilized to close this aperture 11*b* but when it is to be utilized for air supply the closure 11*c* is replaced by the quick connect unit 11*e* and the closure plug 11*c* is now utilized to close the handle passage 12*a*.

When operating under either mode an internal valving mechanism designated in its entirety 35 is provided within passage 19. This valve is rotatably housed in the body 11 of the gun and an internal passage 35*a* extends transversely therethrough such that the air flowing through and into passage 19 may be controlled. This valve 35 is controlled by an external boss 35*b* and will control air whether it enters through the handle 12 and non-bleeding section of the gun or through the passage defined by the threaded opening 11*b* for the air bleeding mode of operation. Valve 35 then provides an internal air flow control to the material discharge end 11*a* of the body 11.

It should be noted that the passages for air flow through the handle 12 and body portion 11 of the unit 10 are of a relatively larger diameter than those utilized in high pressure spray guns. The size of these internal air pressures allow for high CFM and low PSI operations which result in a greater product transfer efficiency in comparison to high pressure systems.

It should be obvious that placement of the air supply hose at either the handle 12 or rear inlet 11*b* of the gun will accommodate utilization of the gun in various physical situations. When spraying in confined areas the particular confinement might result in crimping of the hose and defeat of the air supply when using either of the particular openings and switching to the other may alleviate this situation.

Figure 7:
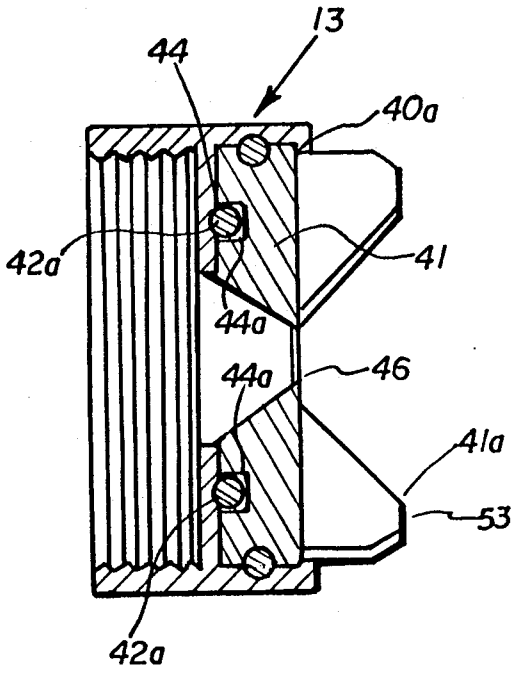
Figure 6:
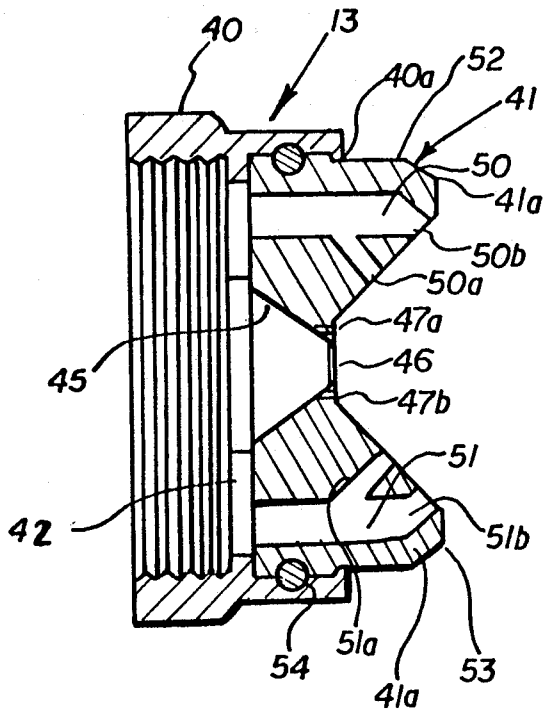
FIG. 6 is a transverse section taken substantially along line 6—6 of FIG. 5 to illustrate the air cap construction; and, FIG. 7 is a transverse section taken along line 7—7 of FIG. 5.
Figure 5:
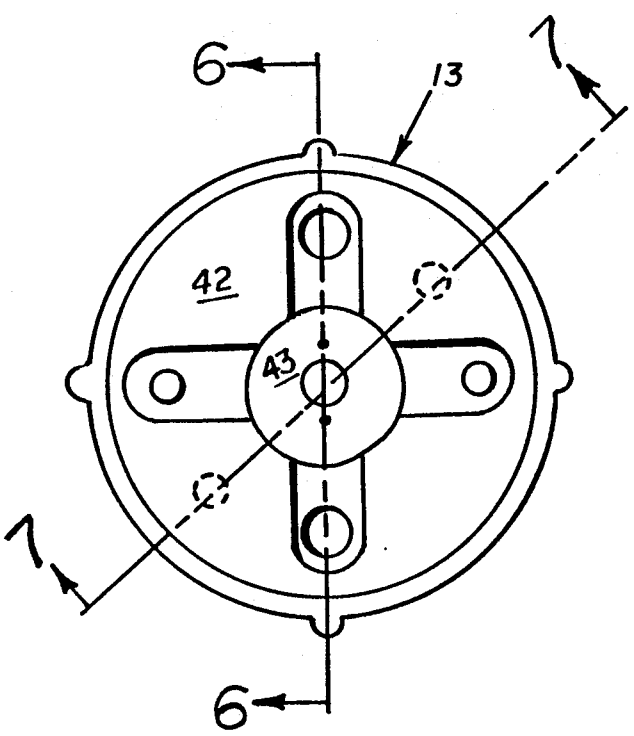
FIG. 5 is a rear elevation view taken substantially along line 5—5 of FIG. 1 illustrating the air cap assembly mechanism for altering the spray pattern of the unit.

The particular construction of the pattern control spray tip 13 is best illustrated in FIGS. 5 and 6 and 7. FIG. 5 is a transverse or vertical section taken substantially along Line 5—5 of FIG. 1 with portions broken away to particularly illustrate the detent locating operation of the unit.

Cap 13 is best illustrated in FIGS. 5, 6 and 7. The cap 13 is of a two part construction including an outer housing 40 and an inner rotatable fan nozzle section 41. Outer housing 40 is threadably attachable to the forwardmost end 11*a* of body 11 of the spray unit 10 and provides a radially inwardly directed flange 40*a* which is of a segmented construction having four inwardly directed, radially spaced, elements 42 with a central open area 43. The inwardly directed segments 42 are provided with ball receiving detents 42*a* thereon to selectively receive a plurality of spring loaded balls 44 which are maintained in rotatable nozzle member 41. As illustrated, the rotatable section is provided with four spring loaded balls, two of which are arranged on one side of member 41 and two of which are arranged on the opposite side thereof with each pair of members spaced at 45°. Such spacing, in combination with the detents 42*a*, will allow the moveable nozzle portion 41 to be shifted into what may be termed a horizontal, vertical and mid-point position. These three positions result in a selectable vertical fan spray pattern, a horizontal fan spray pattern and a circular spray pattern. Moveable member 41 is provided with an internal conical shaped needle receiving area 45 with a central aperture 46 extending therethrough to permit the flow of material and air from the gun 10.

Adjacent the central aperture 46 are two additional relatively small apertures 47*a*–47*b* for the flow of air and material mixture. Control of the shaped resultant spray is maintained through directed air outlets formed through the rotatable element 41 and, as particularly illustrated in FIG. 6 these passages form a straight line bore section 50–51 having inwardly directed sub-passages 50*a*–51*a*, 50*b*–51*b*. These passages and sub-passages being diametrically opposed will force the exiting material from passages 46, 47*a*–47*b* into a flat fan shaped configuration in both vertical and horizontal modes. The control of the resultant material spray is well known in the art and is controlled in the same manner in various other spray guns through forward extensions or fins 47, 48.

It should be noted, that the passages 50–51 and inwardly directed sub-passages 50*a*–51*a*, 50*b*–51*b* are provided within the fins such that air flowing therethrough will impinge upon and form the material exiting the gun. Such impingement in spaced relation from material supply orifice 20*c* is necessary for proper forming control of the spray.

After positioning, the nozzle 13 is locked in position by lock ring 40*b*, also threadably received on end 11*a* of body 11.

The important aspect of the applicant's spray nozzle is that it is only of two piece construction with no locating devices other than the internally mounted ball and spring combinations 44*a*. Most constructions utilize a three piece construction in which the adjustable or shiftable element is maintained in position by a compression spring and the positioning thereof is again maintained through location points between the attachment cap and the shiftable member. With applicant's device the shiftable cap 41 is simply pressed past a body shoulder 40*a* of body 40 and air sealing is effected through an O-ring seal 54 between the outer periphery of the rotatable member 41 and the inner circumference of the cap element 40.

In non-bleeding operation, air is introduced through the handle 12 and its flow into the body and forwardly directed discharge passage 19 is controlled through actuation of the trigger 28 shifting valving member 17 from seat 18. A portion of the air in passage 19 is diverted through pressurizing tube E to the supply cannister C to force material therefrom through discharge conduit D and into the needle valve controlled passage 20*a*. Obviously the amount of material discharged and the ultimate spray is controlled by the amount of trigger actuation. Material exiting from the spray orifice 20*c* is shape controlled by the air passing through the passages 50–51 and the respective sub-passages 50*a*–50*b* and 51*a*–51*b*. Again, internal air flow may be controlled through the valve 35.

In bleeding operation as shown in FIG. 8, air is introduced into body 11 and discharge passage 19 through the threaded passage 11*b* and shifted quick connect 11*e*. The flow is identical to that stated above for the non-bleeding operation.

It should be obvious that the applicant's unit provides a unique spray gun particularly designed for the delivery of viscous covering materials at relatively low pressures and relatively high CFM delivery. With all controls being arranged internally of the spray gun and with the particular air passages through the spray gun affording the high CFM, low pressure air delivery. It should be further obvious that the applicant's material delivery adjustable cap provides a compact unit eliminating multiple piece and separate spring constructions.

What is claimed is:

1. A spray gun for spraying of viscous materials under low pressure and high cubic feet per minute delivery of air capable of operating under bleed or non-bleed conditions comprising:

a. a body member having an internal cavity and arranged and constructed to receive low pressure, high volume air;

b. said body member having relatively large air flow passages therein to direct received air from a first inlet passage for use under non-bleed conditions adjacent the rear of said body member to an air outlet end at the front of said body member, said air flow passages being of a size substantially equal to the internal cavity of said body member such that a high volume of air can be accommodated by said spray gun in the spraying of viscous materials;

c. means for connecting a viscous material supply to said body member adjacent the front thereof including a discharge outlet extending from said supply to said body member;

d. a passage defined in said body member to receive such delivered material and direct the same to an exit orifice at said front of said body member;

e. means for diverting a portion of air traveling within said air flow passages to pressurize said supply for ultimate delivery through said exit orifice;

f. needle valve means arranged in opening and closing relation to said exit orifice;

g. second valving means arranged in one of said air flow passages to control air flow from said first inlet passage to said air flow passages;

h. trigger means rotatably mounted on said body member, said trigger means arranged and constructed to simultaneously shift said needle valve means to permit flow of material through said exit orifice and under non-bleed conditions control said second valving means to allow air to enter said air flow passages and exit the front of said body member;

i. pattern control means for directing said exiting air against the flow of material from said exit orifice whereby the resultant shape of the material spray emitted from said body member is controlled;

j. a third valving means arranged in a second of said air flow passages for controlling of air flow therethrough subsequent to said second valving means; and k. a second air inlet passage for use under bleed conditions adjacent the rear portion of said body member, said second inlet passage being intermediate said second and third valving means such that under bleed conditions, high volume, low pressure air is received through said second air inlet passage and continually flows through said air flow passages of said body member.

2. The spray gun as set forth in claim 1 further comprising handle means sealingly connected to said first inlet passage of said body member, said first inlet passage having an inlet and an air passage therethrough, said handle means having a handle inlet and a handle air passage therethrough connecting said handle inlet and said first inlet passage.

3. The spray gun as set forth in claim 2 wherein said handle means is composed of a relatively low heat conductive material.

4. The spray gun as set forth in claim 3 wherein said handle means is formed of a material consisting of 43% fiberglass filled nylon.

5. The spray gun as set forth in claim 2 and under non-bleed conditions further comprising a quick connect member provided in said handle inlet to accommodate rapid connect and disconnect of said handle means and said gun to a low pressure, high volume air source.

6. The spray gun as set forth in claim 1 further comprising:

a. said needle valve means including a longitudinally extending rod member having a frontal conically shaped surface to control material flow through said exit orifice;

b. said body member providing a spring housing extending rearwardly and outwardly of said body member;

c. the rear end of said needle valve means being positioned in said spring housing;

d. abutment means extending radially outward of said needle valve means within said spring housing; and, e. spring means within said spring housing, said spring means having one end abutting with a portion of said spring housing and the other end abutting with said abutment means of said needle valve means to normally urge said frontal conically shaped surface of said needle valve means into closing position to said exit orifice.

7. The spray gun as set forth in claim 6 wherein said spring housing includes a shiftable cap member providing a portion of said spring housing abutting said spring means and said cap member being longitudinally shiftable on said spring housing whereby the movement of said needle valve means is controlled to thereby control the distance said conically shaped surface may be moved with respect to said exit orifice to control the amount of viscous material passing through said exit orifice.

8. The spray gun as set forth in claim 7 further comprising means for sealing said spring housing to said needle valve means and means for sealing said needle valve means to said body member to prevent leakage of low pressure, high volume air from within said body member.

9. The spray gun as set forth in claim 6 further comprising:

a. A needle valve actuating means including a longitudinally extending, hollow rod having a forward end arranged in close association to said trigger means for movement in response to movement of said trigger means;

b. said needle valve means slideably arranged within said actuating means;

c. said actuating means having a rearward end arranged in close association to said radially extending abutment means of said needle valve means whereby said needle valve means is forced rearwardly against said spring means upon actuation of said trigger means to open said exit orifice.

10. The spray gun as set forth in claim 9 wherein said second valving means is positioned on said needle valve actuating means for movement therewith.

11. The spray gun as set forth in claim 10 further comprising:

a. second spring means interposed between said second valving means and an interior surface of said spring housing to normally urge said second valving means into sealing relation with said body member and urging said actuating means and said trigger means into a forward, non-discharge position.

12. The spray gun as set forth in claim 1 and under bleed conditions further comprising an inlet to said second air passage, a quick connect member being provided in said inlet to accommodate rapid connect and disconnect of said gun to a low pressure, high volume air source.

13. The spray gun as set forth in claim 1 further comprising:

a. said air outlet end of said body member having a threaded receiving portion;

b. said pattern control means comprising a discharge cap threadably received on said threaded receiving portion; and c. said discharge cap including a rotatable, air directing member defining a pair of low pressure, high volume air discharge ports arranged in diametrically opposed relation thereon, said ports being inwardly directed towards said exit orifice of said body member to direct air against material exiting therefrom for formation of a defined material spray pattern.

14. The spray gun as set forth in claim 13 further comprising a lock ring arranged on said threaded receiving portion to lock said discharge cap thereto.

15. The spray gun as set forth in claim 13 further comprising:

a. said discharge cap further comprising an outer portion threadedly received on said threaded receiving portion;

b. said outer portion defining a plurality of inwardly directed flange members, selected of said flange members being provided with detent receiving areas thereon to receive a spring loaded detent therein;

c. said rotatable member of said discharge cap being removably secured to said outer portion and having locating, spring loaded detents thereon in position to engage said detent receiving areas of said outer portion; and d. sealing means arranged exteriorally of said rotatable member and interiorally of said outer portion to prevent leakage of low pressure, high volume air from said discharge cap.

* * * * *